United States Patent [19]
Baur et al.
[11] 4,197,967
[45] Apr. 15, 1980

[54] PISTON-CYLINDER UNIT PARTICULARLY FOR AN EXTRUSION CARTRIDGE

[75] Inventors: Fritz Baur, Leverkusen; Gunther Stemmer, Ennigerloh, both of Fed. Rep. of Germany

[73] Assignees: Denso-Chemie Wedekind KG, Leverkusen; Peter Lancier Maschinenbau-Hafenhütte GmbH & Co. KG, Münster-Wolbeck, both of Fed. Rep. of Germany

[21] Appl. No.: 932,112

[22] Filed: Aug. 9, 1978

[30] Foreign Application Priority Data

Aug. 11, 1977 [DE] Fed. Rep. of Germany ..... 2736144
Mar. 13, 1978 [DE] Fed. Rep. of Germany ..... 2810755

[51] Int. Cl.² ..... B67D 5/42
[52] U.S. Cl. ..... 222/190; 222/386; 366/256
[58] Field of Search ..... 222/386, 386.5, 389, 222/136, 387, 388, 390, 391; 366/255, 256, 189

[56] References Cited

U.S. PATENT DOCUMENTS

| | | | |
|---|---|---|---|
| 3,140,078 | 7/1964 | Krahe et al. | 222/386 X |
| 3,144,966 | 8/1964 | Cook | 222/386 X |
| 3,164,303 | 1/1965 | Trautmann | 222/190 |
| 3,217,946 | 11/1965 | Cook | 222/386 |
| 3,437,242 | 8/1969 | Poitras | 222/386 X |
| 3,794,221 | 2/1974 | Hostettler | 222/386 X |

FOREIGN PATENT DOCUMENTS

| | | | |
|---|---|---|---|
| 813500 | 6/1937 | France | 222/386 |

*Primary Examiner*—Allen N. Knowles
*Attorney, Agent, or Firm*—Spencer & Kaye

[57] ABSTRACT

A piston-cylinder unit includes a cylinder having an inner cylindrical wall face; a pressure piston slidably accommodated in the cylinder and arranged for being driven into the cylinder by an external force. The cylinder defines a cylinder chamber in which pressure is generated by the pressure piston forced into the cylinder. The pressure piston has a radial bottom and a generally cylindrical outer face extending axially away from the piston bottom. In the outer face of the pressure piston, adjacent the bottom, there is provided a circumferential recess which, together with an overlying circumferential portion of the inner cylindrical wall face of the cylinder defines an annular chamber surrounding the pressure piston. The radially measured width of the annular chamber gradually decreases in a direction axially away from the piston bottom. A sealing ring is disposed in the annular chamber and sealingly engages the inner face of the cylinder even when situated in the widest zone of the annular chamber. The sealing ring can be shifted and compressed into zones of lesser width of the annular chamber upon displacement of the pressure piston into the cylinder.

8 Claims, 7 Drawing Figures

PISTON-CYLINDER UNIT PARTICULARLY FOR AN EXTRUSION CARTRIDGE

BACKGROUND OF THE INVENTION

The invention relates to a piston-cylinder unit having a sealed pressure piston, preferably for extrusion cartridges for liquids having a higher viscosity. Such piston-cylinder units are used in hydraulic systems, control and slide valve rods, pressure generators or extrusion units, such as, for example, caulking gun-operated extrusion cartridges for pasty putties or for liquids such as, for example, colored lacquers. The invention is used, in particular, with ready-to-use cartridges in which the piston is formed by the bottom of the pressing closure.

Particularly in the above-mentioned extrusion devices, the pressure pistons have a pressure build-up effect only in one direction so that a seal against the inner wall of, for example, a cylindrical extrusion unit or cartridge, as the case may be, need be effective in only one direction of movement. The cartridges are designed as piston-cylinder units constituted by slender cylindrical vessels which have a fixed bottom provided with an openable discharge opening, preferably shaped as an extrusion nozzle, and a bottom closure which is axially movable within the cylinder and acts as a pressure piston. Thus, the bottom closure can be moved in the direction of the medium in the cartridge by means of an attachable pressure plunger of the caulking gun for expelling the medium through a discharge opening by compression. Seals are known for this purpose which employ sealing cuffs similar to those on an air pump valve or seals formed as annular circumferential collars along the outer wall of the cylindrical pressure piston.

Particularly in the field of ready-to-use cartridges, the cylindrical cartridges as well as the pressure pistons inserted into the cartridges are made of plastic or plastic-like materials, which become flowable under a permanent compression stress even at normal temperatures and are partially plastically deformed. Thus high quality sealing means which act with greater sealing forces on the inner walls of the cartridge can usually not be used. Since the storage period of such cartridges may, under certain circumstances, extend over several months before use, the pressure forces would act on the same portions of the walls during this storage period and could produce undesirable deformations. For that reason, the sealing systems for this field of application are designed so that the sealing forces remain correspondingly small in order to avoid deformations.

Because of the above circumstances, however, failure of the seal between the piston wall and the cartridge result already during storage or under a light permanent pressure on the bottom of the piston. This leads to leakages even before use, resulting in losses of some of the material and in soiling of the processing devices.

As already mentioned, it is known to use sealing cuffs or piston ring seals of the shaft sealing ring type.

SUMMARY OF THE INVENTION

It is an object of the invention to provide a piston-cylinder unit of the above-mentioned type which can be manufactured economically and does not have the above-described drawbacks.

This object and others to become apparent as the specification progresses, are accomplished by the invention, according to which, briefly stated, the cylindrical outer face of the pressure piston is provided with a circumferential recess about that part which adjoins the piston bottom. The recess forms an annular chamber with the cylinder wall. The chamber has a cross section which decreases from the piston bottom. Further, a sealing ring is disposed in the chamber in the region of its largest cross section so as to sealingly contact the cylinder wall. The chamber is designed so that its wall facing the cylinder wall is conical, thus creating a larger and a smaller region in the chamber between pressure piston and interior cylinder wall. This oblique wall is bounded by two radially extending chamber walls wherein the radially taller wall is associated with the pressure bottom of the pressure piston and the radially shorter wall is associated with the cylindrical edge of the pressure piston. A sealing ring of elastomer material which is resistant chemically and physically to the contents of the cartridge is inserted into the annular chamber in such a manner that it is already slightly compressed with respect to the interior cylinder wall in the (wider) region of the chamber and thus forms a seal toward the outside. Due to the conical configuration of the chamber, the sealing ring is capable of sliding out of its above-noted position when the pressure piston is shifted, into the smaller area of the chamber and can thus form a seal against increasingly higher pressures.

Shifting of the sealing ring in the chamber is effected by a thrust force applied to the cylindrical pressure piston in the direction of the medium to be pressed so that a hydraulic pressure of identical magnitude acts across the interstice between the radially tall chamber wall and the inner wall of the cylinder, pressing the sealing ring toward the rear and thus forcing it into its compressed position. Upon the build-up of larger pressure forces, the sealing ring can be pressed maximally to a point where it presses against the rearward, radially short chamber wall, thus defining its final position.

The above-described sealing system according to the invention has the significant advantage that in its rest position, the sealing ring presses against the piston body as well as against the cylinder wall with very little sealing force and thus forms, with small forces, a seal against static pressures. Only in use and thus upon movement of the pressure piston in the direction toward the content to be processed will the increasing hydraulic pressure exerted on a portion of the ring surface in the region of the radially tall chamber wall press the sealing ring backwards into the continuously narrowing chamber and generate a stronger sealing effect in accordance with the increasing pressure. Thus it is assured that even during longer periods of storage—or a longer idle period of the sealing ring without activation of the apparatus—the sealing ring will not be subject to fatigue as a result of relaxation of tension in spite of its permanent inherent elasticity and thus will not fail in its sealing function.

In a piston-cylinder unit including, in particular, a pressure piston of the above-described type and a divider disposed in the cylinder chamber at a distance from the pressure piston, a particular embodiment of the invention provides that the divider is formed by a mixing piston which has a cylindrical, centered and continuous, internally threaded sleeve for accommodating a mixing rod and which further has openings, as well as a surrounding annular collar into which a washer can be tautly and tightly inserted to form a sealing disc.

This embodiment has the advantage that multicomponent—preferably two-component—adhesives, putties, cast masses, insulating masses and others can be used. In case of multicomponent products of the abovementioned type, however, the manufacturer of such products is faced with the problem of packaging these components together but well separated in suitable packages as well as designing these packages to simultaneously serve as processing tools for the user who thus can easily, safely and intimately mix the previously separated components in simple and dependable manipulation and use them directly out of the package. Cylindrical cartridges have been found to be particularly suitable packages for the preferably two-component liquid products. These packages are produced with standard dimensions so that they can be inserted into caulking guns which are operated manually or with compressed air and with which the contents of the cartridges can be expelled for processing.

For multicomponent, preferably two-component contents of preferably liquid components, dividers such as dividing discs or tight membranes or the like must be provided additionally between the components to ensure that the components are safely separated from one another during storage and shipment, and that an easy and dependable mixing of the components for use is not impaired.

Two-component cartridges are known where the dividers perform the dividing function and are at the same time designed so that they can be used as mixing piston to mix the components. Such known cartridges preferably include disc-shaped, circular plates provided with special openings which are sealed until processing starts. The mixing pistons are then moved axially up and down in the cartridges by means of a rod assembly introduced through the discharge opening, whereby the components are mixed together while flowing, as a result of pressure, through the openings in the mixing piston.

In a known construction, a separation of the products is effected by an aluminum foil which acts as a sealing disc and is applied to the entire surface of the mixing piston which, as described above, has been provided with openings. In addition to covering the openings in the mixing piston, the aluminum foil is clamped to the guides to seal against the cartridge wall. During use, the mixing piston which is covered before the mixing process must be moved suddenly in one direction by the mixing rod which has been introduced through the extrusion opening and threaded into the mixing piston. As a result, the aluminum foil is ripped open or popped away from the mixing piston by the pressure exerted by one of the products.

It is a significant drawback of this arrangement that when the mixing piston is subsequently moved in the other direction, the torn-open or ripped-off foil acts like a valve flap which recloses the previously exposed openings in the piston and thus interferes with the mixing process or even makes it impossible.

A further drawback of these constructions is that the cylindrical wall of the mixing piston is not designed as a genuine sealing surface toward the cylindrical wall of the cartridge and therefore the elastic deflection of the wall must be prevented precisely at this location by a subsequently applied external wrapping with non-stretch adhesive tapes. Due to the fill tolerances for machine filling of both components and wrapping, the wrap will not always be at exactly the same position with respect to the position of the mixing piston so that there may occur a flow of one or both components between the contact surfaces.

The divider according to the invention eliminates the abovementioned drawbacks.

According to an advantageous embodiment of the invention, the mixing piston is provided, at its wall facing the cylinder wall of the cartridge, with at least one circumferential seal, preferably with sealing lips. Thus, even with possible tolerances for the seal or with an elastic or plasto-elastic deformation of the walls, sufficient pressure will always be generated—due to its range of operation—to permanently seal the piston against the wall. At the same time, warp-free guidance of the mixing piston in the cylinder is possible during the subsequent mixing step. For the mixing process itself, the disc-shaped mixing piston is perforated by circular or segment-shaped openings or recesses.

These openings in the mixing piston are initially tightly covered by a washer which is tautly and tightly engaged in a collar at one side of the mixing piston. A central opening in the mixing piston is designed as a sleeve with internal thread so that the externally threaded mixing rod required for the mixing process can be inserted and threaded into the sleeve.

The threaded sleeve of the mixing piston is open toward the washer so that when the mixing rod is screwed in, the washer is raised in the center and disengaged from its mount in the collar at the mixing piston. The washer thus frees the openings in the mixing piston and is held at a distance from the mixing piston by the mixing rod. The mixing piston can now be pressed in the direction toward the pressure piston of the cartridge or the cylinder so that the component product disposed in this part of the cylinder or cartridge can move to the other part and be mixed with the other component product while the mixing piston continues to be reciprocated. The washer comes to rest against the pressure piston during the first inward movement of the mixing piston. Upon completion of mixing of the two components, the mixing rod is unscrewed, retracted and an extrusion nozzle or extrusion hose is attached to the discharge opening. The pressure piston of the cartridge can then be pressed with the manually or pneumatically operating extruder (caulking gun) against the mixture in the cylinder chamber, the washer remaining flush with the pressure piston.

The use of the divider according to the invention is not limited to pressure pistons of the type according to the invention. This divider can also be used to advantage for conventionally designed pressure pistons.

DESCRIPTION OF THE PREFERRED EMBODIMENTS

Figure 1:
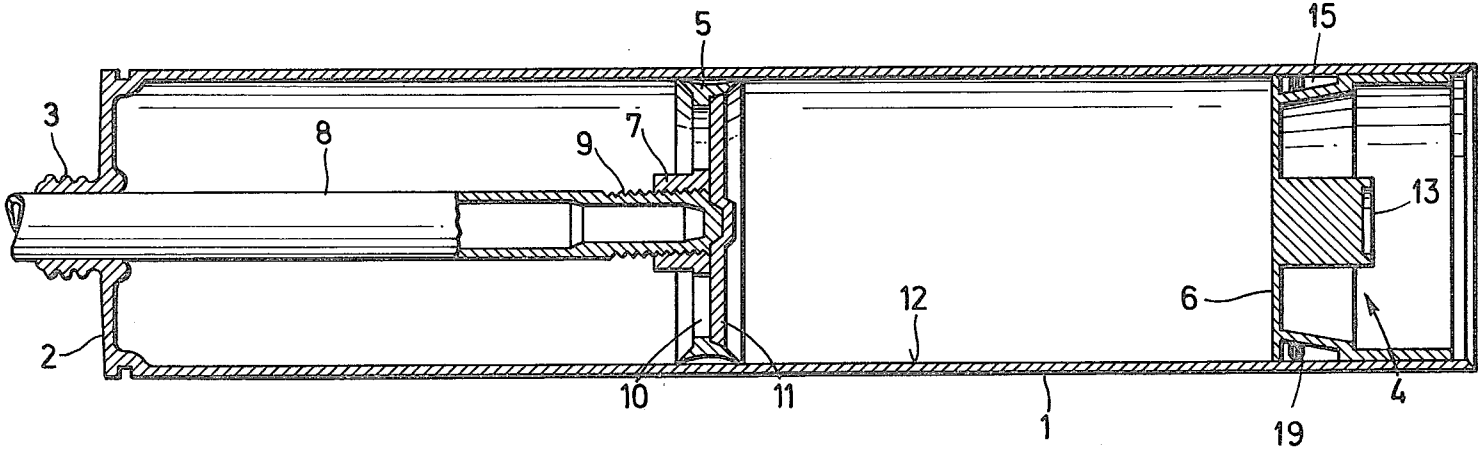
FIG. 1 is an axial sectional view of a cylindrical cartridge according to a preferred embodiment for accommodating and processing a two-component product.

The ready-for-use cartridge for a two-component product shown in FIG. 1 includes a cylinder 1 closed at its one end by a fixed bottom 2 which is provided with a discharge opening 3. The discharge opening 3 is formed by a threaded sleeve to which an extrusion nozzle or an extrusion hose can be screwed. The other end of the cylinder is closed by a pressure piston 4 whose structure will be described in detail with the aid of FIG. 2. A divider 5, which simultaneously serves as a mixing piston and which will hereinafter be referred to as the mixing piston, dividers the interior of the cylinder into two chambers between the piston bottom 6 and the fixed cartridge bottom 2. The position of the mixing piston 5 within the interior of the cylinder depends on the volume ratios of the two components which will be mixed during later use. The structure of the mixing piston will be explained in detail below in connection with FIGS. 4–7. The mixing piston is provided with a centrally disposed threaded sleeve 7 into which a mixing rod 8 can be screwed after intradirection through the discharge opening 3. For this purpose, the free end of the mixing rod 8 is provided with a threaded extension 9. The mixing piston is further provided with one or a plurality of passage openings 10 which, however, are covered by a washer 11 during charging and storage. The outer surface of the mixing piston 5 facing the interior of the cylinder wall 12 contacts the cylinder wall 12 by means of sealing elements, preferably lip-like sealing elements.

Figure 2:
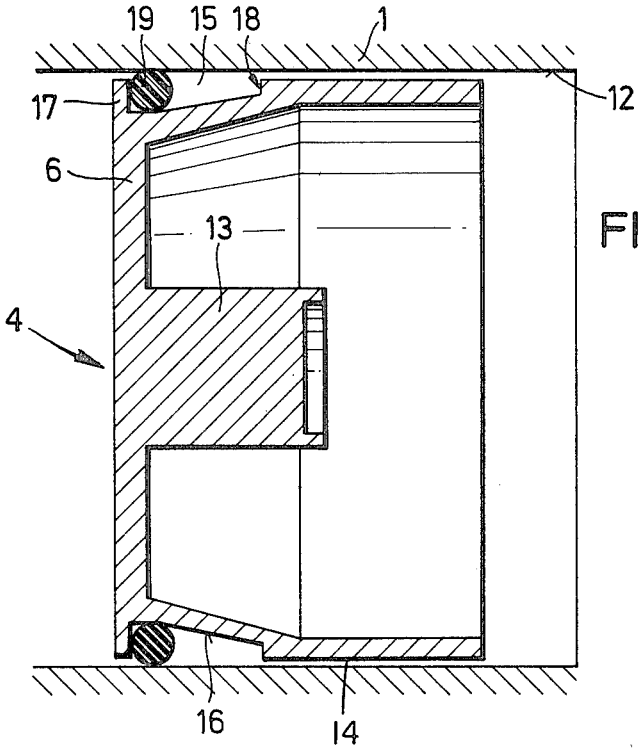
FIG. 2 is an enlarged axial sectional view of a pressure piston comprised in the preferred embodiment.
Figure 3:
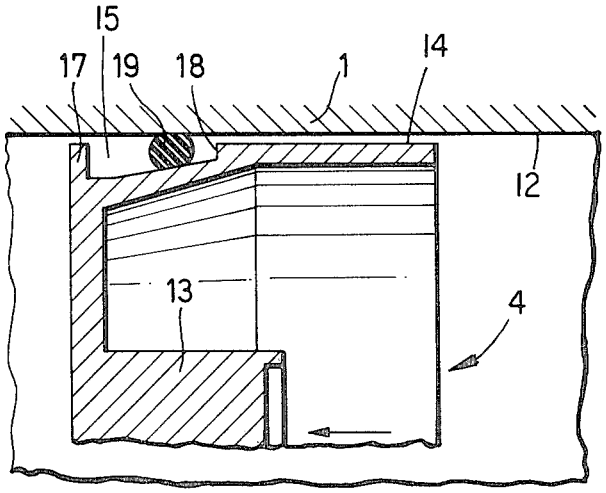
FIG. 3 is a fragmentary axial sectional view of the pressure piston according to FIG. 2 after actuation.
Figure 4:
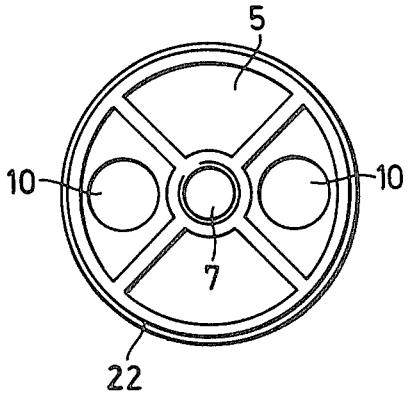
FIG. 4 is a top plan view of a mixing piston without washer.
Figure 5:
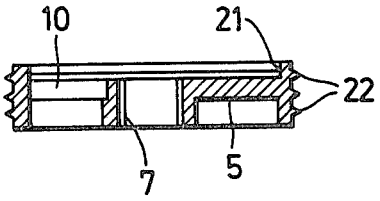
FIG. 5 is an axial sectional view of the mixing piston of FIG. 4.
Figure 6:
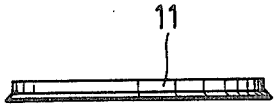
FIG. 6 is a side view of a washer comprised in the preferred embodiment.
Figure 7:
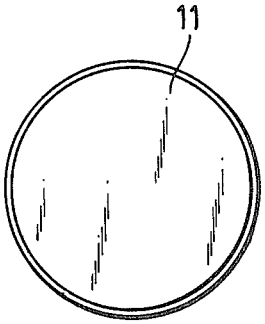
FIG. 7 is a top plan view of the washer of FIG. 6.

Also referring to FIGS. 2 and 3, the cylindrical pressure piston 4 of the unit essentially includes a hollow cylinder with a piston bottom 6 and is provided with a piston body 13 which is centered on the pressure bottom 6 so as to absorb the pressure force of a pressure plunger that can be attached thereto. In the cylindrical outer face 14 of the pressure piston 4, immediately behind the piston bottom 6, there is provided a circumferential recess 15, whose one wall 16 is oblique wih respect to cylinder wall 12. The recess is defined by a radially relatively tall chamber wall 17 and a radially relatively short chamber wall 18 so that, together with the inner face of the cylinder wall 12, a closed conical chamber is formed which is conically tapered away from the piston bottom 6. A sealing ring 19 is positioned in the chamber in such a manner that it is compressed slightly (up to 20%, preferably 10%) at the widest point of the chamber between chamber wall 16 and the inner face of the cylinder wall 12 of the cartridge.

When the apparatus is actuated, i.e. pressure is exerted on the pressure piston 4 in the direction of the arrow 20 (FIG. 3), a hydraulic pressure is generated within the cartridge. This pressure, due to the clearance between the walls 12 and 17, also prevails in the conical chamber 15. This pressure forces the sealing ring 19 into the narrower region of the conical chamber.

The principle of the sealing system according to the invention is not limited to use with cartridges. It can also be used in many other technical procedures where a secure seal between a pressure plunger and a charge of paste-like or liquid materials contained in a cylindrical body is required.

The divider shown in FIGS. 1 and 4 through 7 consists of two parts, the actual mixing piston 5 and the washer 11, whose edge is so designed that it can be tightly and tautly seated in an annular collar 21 of the mixing piston 5. This tightly seals the openings 10 and the central threaded sleeve 7.

Upon threading the mixing rod 8 into the sleeve 7, the leading end of the mixing rod 8 raises the washer 11, by engagement with its center, to such an extent that the washer 11 is disengaged from the collar 21 of the mixing piston. The cylindrical outer face of the mixing pistion is additionally provided with sealing lips 22 to seal it against the inner face of the cylindrical walls 12. The inner diameter of the collar 21 is somewhat smaller than the outer diameter of washer 11 so that when the washer is inserted, the outer circumferential edge of collar 21 engages the inner face of the wall 12 of the cylinder in a lip-like manner. As the washer is pressed out by the mixing rod 8, this seal is broken and the mixing piston 5 can be moved back and forth with the mixing rod 8 in the cartridge with reduced friction so as to mix the two components. Upon completion of the mixing process, the mixing piston 5 is pressed against the pressure piston 4 and the mixing rod is unscrewed and extracted from the cartridge. The completely mixed product, for example an adhesive or a putty, can be pressed out by means of appropriate actuating means, such as a caulking gun, which act on the pressure piston 4.

It is to be understood that the above description of the present invention is susceptible to various modifications, changes and adaptations and the same are intended to be comprehended within the meaning and range of equivalents of the appended claims.

What is claimed is:

1. In a piston-cylinder unit including a cylinder having an inner wall face; a pressure piston slidably accommodated in the cylinder and arranged for being driven into the cylinder by an external force; the cylinder defining a cylinder chamber in which pressure is generated by the pressure piston forced into the cylinder; the pressure piston having a radial bottom and a generally cylindrical outer face extending axially away from the piston bottom; sealing means carried by the pressure piston for sealingly engaging said inner wall face; the improvement comprising a dividing means arranged in said cylinder chamber for dividing said cylinder chamber into axially adjacent part chambers; said dividing means comprising (a) a mixing piston slidably arranged in said cylinder and including
  (1) an outer face for engaging the inner face of said cylinder;
  (2) means defining a throughgoing threaded central opening;
  (3) means defining at least one throughgoing aperture adjacent said central opening;
  (4) retaining means;
(b) a washer disc normally firmly held on said mixing piston by said retaining means for sealing off said central opening; and
(c) a mixing rod axially introduceable into said cylinder through a cylinder end remote from said pressure piston and threadedly receiveable by said central threaded opening; said washer disc being axially disengageable from said retaining means by said mixing rod for establishing communication between said part chambers through said aperture.

2. A piston-cylinder unit as defined in claim 1, wherein said mixing piston and said washer disc are of the same material.

3. A piston-cylinder unit as defined in claim 1, wherein said mixing piston and said washer disc are of different materials.

4. A piston-cylinder unit as defined in claim 1, wherein said mixing piston includes a resiliently deformable part having an outer surface constituting at least an annular part of said outer face of said mixing piston; said outer surface having circumferential sealing means for cooperating with said inner wall face of said cylinder; further wherein said retaining means comprises a circumferential collar formed on said deformable part; and further wherein an inner diameter of said circumferential collar is slightly less than an outer diameter of said washer disc, whereby said washer disc, when firmly in place on said mixing piston, deforms said deformable part radially outwardly, pressing said circumferential sealing means against said inner wall face of said cylinder; and further whereby the frictional engagement between said circumferential sealing means and said inner wall face of said cylinder is at least reduced by an elastic contraction of said circumferential collar as said washer disc is unseated.

5. In a divider assembly disposed in a hollow body for dividing the internal space thereof into part chambers, the hollow body having an inner face; the improvement comprising (a) a mixing piston slidably arranged in said space and including
  (1) an outer face for engaging said inner face;
  (2) means defining a throughgoing threaded central opening;
  (3) means defining at least one throughgoing aperture adjacent said central opening;
  (4) retaining means;

(b) a washer disc normally firmly held on said mixing piston by said retaining means for sealing off said central opening; and (c) a mixing rod axially introduceable into said hollow body through an end and threadably receivable by said central threaded opening; said washer disc being axially disengageable from said retaining means by said mixing rod for establishing communication between said part chambers through said aperture.

6. A divider assembly as defined in claim 5, wherein said mixing piston and said washer disc are of the same material.

7. A divider assembly as defined in claim 5, wherein said mixing piston and said washer disc are of different materials.

8. A divider assembly as defined in claim 5, wherein said mixing piston includes a resiliently deformable part having an outer surface constituting at least an annular part of said outer face of said mixing piston; said outer surface having circumferential sealing means for cooperating with said inner face of said hollow body; further wherein said retaining means comprises a circumferential collar formed on said deformable part; and further wherein an inner diameter of said circumferential collar is slightly less than an outer diameter of said washer disc, whereby said washer disc, when firmly in place on said mixing piston, deforms said deformable part radially outwardly, pressing said circumferential sealing means against said inner face of said hollow body; and further whereby the frictional engagement between said circumferential sealing means and said inner face of said hollow body is at least reduced by an elastic contraction of said circumferential collar as said washer disc is unseated.

* * * * *